US008689898B2

(12) United States Patent
Benesch

(10) Patent No.: US 8,689,898 B2
(45) Date of Patent: Apr. 8, 2014

(54) REMOVABLE LOADER FOR ALL-TERRAIN AND UTILITY-TERRAIN VEHICLES

(76) Inventor: Brian Anthony Benesch, Fridley, MN (US)

( * ) Notice: Subject to any disclaimer, the term of this patent is extended or adjusted under 35 U.S.C. 154(b) by 246 days.

(21) Appl. No.: 12/987,907

(22) Filed: Jan. 10, 2011

(65) Prior Publication Data

US 2011/0168417 A1 Jul. 14, 2011

Related U.S. Application Data

(60) Provisional application No. 61/293,626, filed on Jan. 9, 2010.

(51) Int. Cl.
*E02F 3/76* (2006.01)

(52) U.S. Cl.
USPC ..... 172/829; 37/235; 37/417; 37/231; 172/272

(58) Field of Classification Search
USPC ..... 172/272, 27, 817, 829; 37/231, 235, 37/417, 468, 264
See application file for complete search history.

(56) References Cited

U.S. PATENT DOCUMENTS 1,473,890 A * 11/1923 Toy et al. ..... 172/240
1,510,824 A * 10/1924 Bird ..... 37/441
2,437,808 A * 3/1948 Drettmann ..... 414/714
2,691,453 A * 10/1954 Knoploh ..... 414/717
2,745,564 A * 5/1956 Billenstein ..... 414/712
2,776,767 A * 1/1957 Stover ..... 414/717
2,780,374 A * 2/1957 McElhinney et al. ..... 414/717
2,808,950 A * 10/1957 McDonnell ..... 414/715
2,843,947 A * 7/1958 Anderson et al. ..... 37/407
3,048,292 A * 8/1962 Kohorst et al. ..... 414/725
3,079,021 A * 2/1963 Kohorst et al. ..... 414/725
3,305,952 A * 2/1967 Dressler ..... 37/104
4,076,080 A * 2/1978 Anderson ..... 172/821
4,222,442 A * 9/1980 Westendorf et al. ..... 172/273
4,658,519 A 4/1987 Quenzi
4,680,880 A 7/1987 Boneta
4,795,305 A * 1/1989 Friend ..... 414/709
5,136,795 A 8/1992 Rosenberg
5,329,708 A 7/1994 Segorski et al.
5,485,690 A * 1/1996 MacQueen ..... 37/271
5,595,007 A 1/1997 Biance
5,802,746 A 9/1998 Miller
5,909,960 A 6/1999 Jager et al.
6,874,260 B2 4/2005 Mullett
6,874,582 B2 4/2005 Hollinrake et al.
6,957,705 B2 * 10/2005 O'Brien et al. ..... 172/831
7,134,227 B2 * 11/2006 Quenzi et al. ..... 37/274
7,146,754 B2 * 12/2006 Schultz et al. ..... 37/231
7,430,821 B2 * 10/2008 LeBlond et al. ..... 37/231
7,699,577 B2 4/2010 Lougheed et al.

* cited by examiner

*Primary Examiner* — James L McGowan
(74) *Attorney, Agent, or Firm* — James L. Lund, Esq.

(57) ABSTRACT

A multi-use attachment device that is easily attached to and removed from an all-terrain vehicle (ATV) or a utility-terrain vehicle (UTV) comprises a lift frame including an inner lift frame, an outer lift frame, a first pivotal axis and a second pivotal axis, and is configured to pivot about the first pivotal axis with a first electrical device, and has a second electrical device mounted on the lift frame to pivot the outer lift frame with respect to the inner lift frame. One end of the multi-use attachment is attached to the ATV/UTV, and the other end is attached to an implement such as a loader bucket, a pallet fork, or a plow blade. Some embodiments of the multi-use attachment use tension devices both for pivoting the lift frame about the first pivotal axis and for pivoting the outer lift frame with respect to the inner lift frame about the second pivotal axis.

20 Claims, 11 Drawing Sheets

20, 600
500
520
550
552
554
602
604
605
606
608
610
611
612
614
616
618
620
640
642
644
546
548
624
630
660
662
663
664
666
668
670
672
674
676
678
680
682
650
710
712
800
544

REMOVABLE LOADER FOR ALL-TERRAIN AND UTILITY-TERRAIN VEHICLES

RELATED APPLICATION DATA

This application claims priority from U.S. provisional application Ser. No. 61/293,626 filed Jan. 9, 2010, that we incorporate by reference.

FIELD OF THE INVENTION

The present invention relates to equipment used with all-terrain and utility-terrain vehicles, and, in particular to a multifunctional loader attachment.

BACKGROUND OF THE INVENTION

All-terrain vehicles (ATVs) are used for transportation, recreation, and as tools to help get work done around a person's home, garden, or farm. Utility-terrain vehicles (UTVs) are a cousin of all-terrain vehicles with similar functionality, but with more truck-like features whose use is more focused on doing work around a person's home, garden, or farm. The use of these vehicles for work not only saves the user time, but also prevents back and muscle injuries due to overexertion. Add-on equipment is available, for example, to mow lawns, aerate lawns, transport materials, in baskets or carts for example, and plow snow from one's driveway. When making a purchasing decision, a prospective buyer of such add-on equipment weighs factors such as ease of use, convenience in attaching and detaching the add-on equipment, as well as expense. This decision usually precludes the use of traditional hydraulic systems due to their large initial expense, the time and effort required to install and remove these systems from the multi-use ATV/UTV (a separate hydraulic pump is usually driven by a vehicle engine through a V-belt, which makes retrofitting ATVs/UTVs, let alone removing such systems, impractical), and the inconvenience of dealing with hydraulic fluid leaks and system maintenance. While many types of add-on equipment are available to the ATV/UTV owner, the functionality of a loader has not been incorporated into a standalone attachment available for use on such widely used vehicles.

Therefore, what is needed is an attachment for all-terrain vehicles and utility-terrain vehicles that conveniently provides the functionality of a loader to these widely used vehicles without the expense, permanence, and hassle of traditional hydraulic systems.

BRIEF DESCRIPTION OF THE INVENTION

The present disclosure solves many of the disadvantages associated with existing all-terrain and utility-terrain vehicle attachments.

A removable loader for an all-terrain vehicle is herein disclosed as comprising an inner lift frame having first and second ends, a first pivotal axis, wherein the inner lift frame first end is configured to be pivotally mounted to a frame mount at the first pivotal axis, an outer lift frame having first and second ends, wherein the outer lift frame has a linkage at the outer lift frame first end and an implement mount at the outer lift frame second end, wherein the linkage is pivotally connected to the inner lift frame at the outer lift frame first end, and wherein the implement mount is pivotally connected to the inner lift frame second end, an implement, wherein the implement is mounted to the implement mount and pivots about a second pivotal axis, and an electric actuator to provide a force that pivots the implement about the second pivotal axis.

A utility terrain loader vehicle is also herein disclosed as comprising a utility terrain vehicle, a frame mount mounted on the utility terrain vehicle, a lift frame comprising an inner lift frame, an outer lift frame, a first pivotal axis, and a second pivotal axis, wherein the inner lift frame has first and second ends, wherein the inner lift frame first end is attached to the frame mount, and wherein the outer lift frame has first and second ends, wherein the outer lift frame has a linkage at the outer lift frame first end and an implement mount at the outer lift frame second end, wherein the linkage is pivotally connected to the inner lift frame at the outer lift frame first end, and wherein the implement mount is pivotally connected to the inner lift frame second end, a first tension device configured to provide a lift force to the lift frame so that the outer lift frame pivots about the first pivotal axis, an implement, wherein the implement is mounted to the implement mount and is configured to pivot about the second pivotal axis, and a second tension device mounted on the lift frame, wherein the second tension device is configured to provide a force that pivots the implement about the second pivotal axis.

A multi-use attachment for an ATV/UTV vehicle is also herein disclosed as comprising a lift frame comprising an inner lift frame and an outer lift frame, attachment means configured to attach a first end of the lift frame to an ATV/UTV vehicle frame, a first pivotal means to pivot the lift frame about a first pivotal axis that is located at a first end of the lift frame, a second pivotal means to pivot the outer lift frame relative to the inner lift frame, electrical means to pivot the outer lift frame with respect to the inner lift frame, and means for attaching an implement to a second end of the lift frame.

BRIEF DESCRIPTION OF THE DRAWINGS

FIG. 3 shows a perspective view of another exemplary embodiment of the loader attachment apparatus attached to an all-terrain vehicle (ATV) or utility-terrain vehicle (UTV) through an exemplary frame mount that is mounted to the ATV/UTV. FIG. 3A shows a detailed view of the exemplary frame mount, while FIGS. 3B and 3C show top plan views of how the loader attachment apparatus attaches to the frame mount.

DETAILED DESCRIPTION

Figures 1, 1A, 1B:
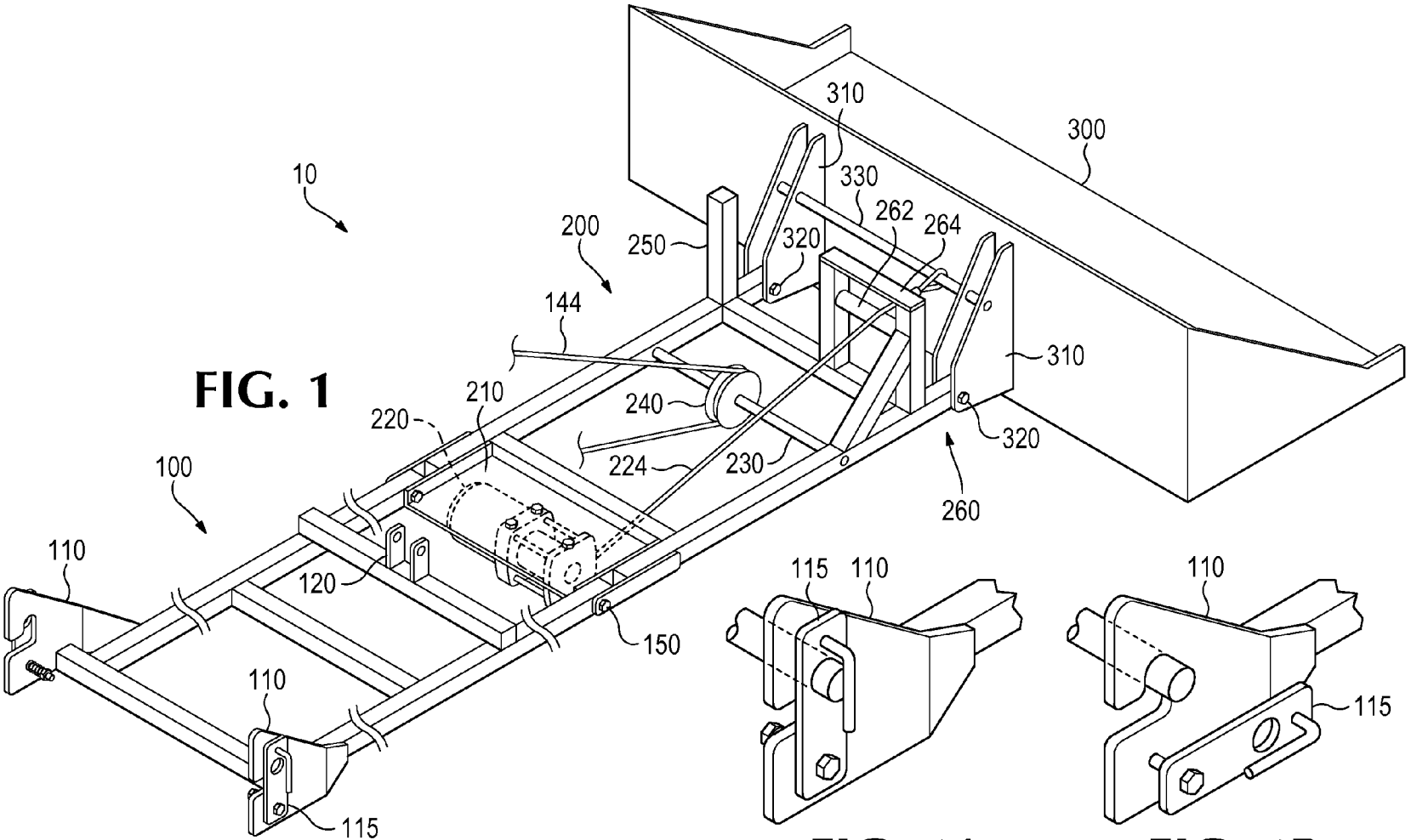
FIG. 1 shows a perspective view of an exemplary embodiment of the loader attachment apparatus before attachment to an all-terrain vehicle (ATV) or utility-terrain vehicle (UTV).
FIGS. 1A and 1B show how rear mounting brackets are attached to posts on a vehicle frame.

In the drawings like reference numerals generally designate identical or corresponding parts throughout the several views.

Loader Attachment Apparatus

Figure 2:
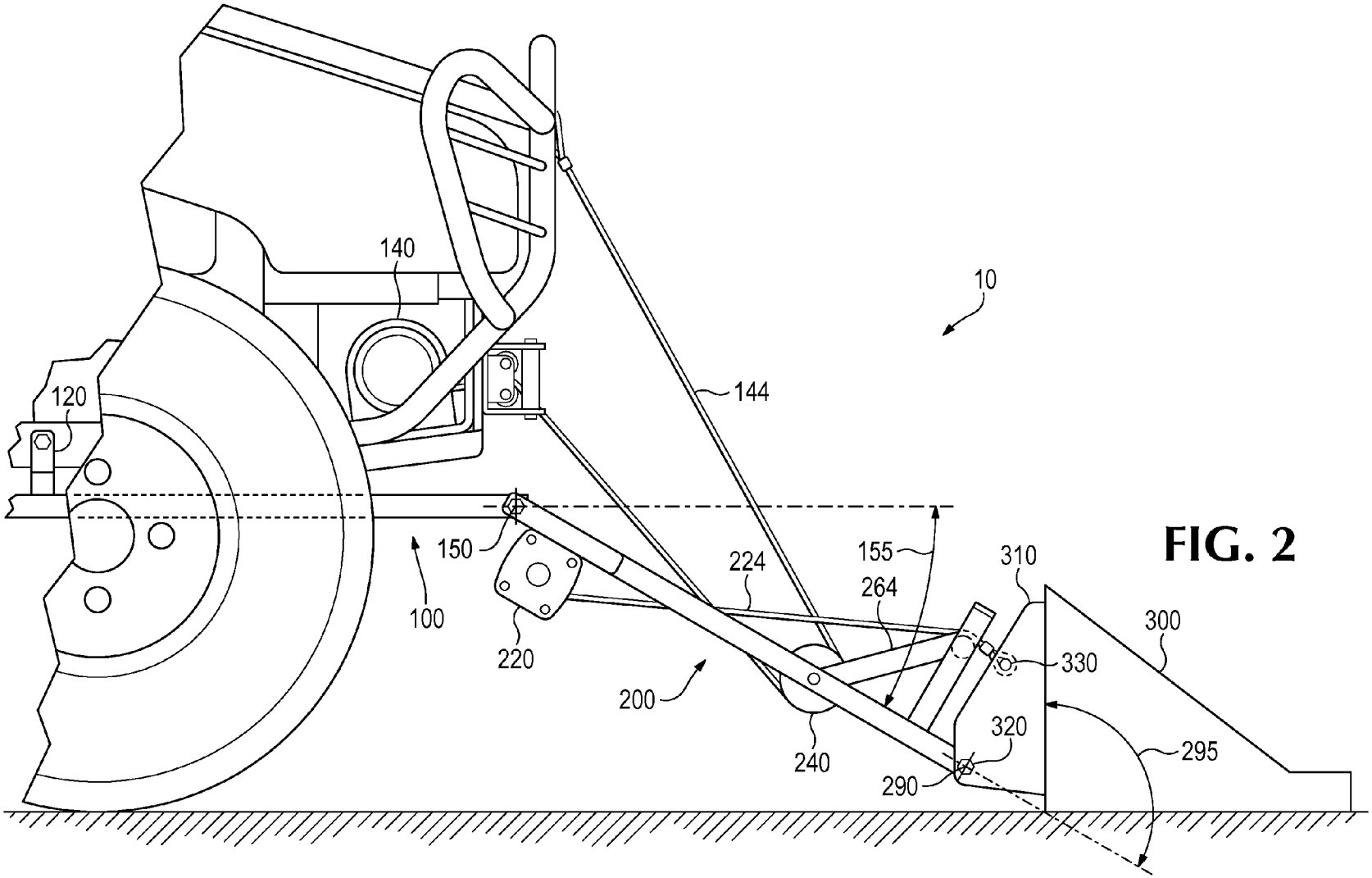
FIG. 2 shows a side elevation of an exemplary embodiment of the loader attachment apparatus attached to an all-terrain vehicle.

Referring now to FIGS. 1 and 2, there is shown an exemplary embodiment of a loader attachment apparatus 10. In general, loader attachment apparatus 10 comprises a push frame 100, which is configured to attach to a frame of an all-terrain or utility-terrain vehicle. The push frame 100 is pivotally attached to a lift frame 200 about a first pivotal axis 150. The lift frame 200 may be rotated about the first pivotal axis 150 through a first pivot angle 155 (shown in FIG. 2). The first pivot angle 155 may be from 0 degrees, as shown in FIG. 2, to 110 degrees in a fully lifted position (not shown). In addition, a tension device, such as a first winch 140 is attached to the frame of the all-terrain or utility-terrain vehicle as shown, for example, in FIG. 2. Many ATV/UTV owners have installed such winches on their vehicles already, along with cable alignment rollers, as shown in FIG. 2. The front-mounted winch is a valuable tool in freeing a stuck vehicle in the backcountry, where an immobile vehicle can jeopardize the lives of those relying on the vehicle to return to locations where ample food and shelter are available. The first winch 140 runs off electricity (typically 12 volts) and is used to apply force through a first cable 144 (lift cable) to the lift frame 200. Winches that may typically be used include models that may supply from around 1000 to around 4000 pounds of tensile force. Alternately, other electrical means for providing a force to the lift frame 200, such as a first linear actuator 142 (not shown) may be used. Currently available linear actuators typically supply around 1400 pounds of force in a 12 volt model. Additionally, an electricity-based hydraulic actuator system or an electro-mechanical actuator may be used to supply the force to the lift frame 200, in addition to supplying forces to tilt the bucket 300 about the second pivotal axis 290.

The push frame 100 includes rear mounting brackets 110 and a frame mounting bracket 120, for example, to mount the loader attachment apparatus 10 to an all-terrain or utility-terrain vehicle. The rear mounting brackets 110 shown incorporate spring loaded rear mounting bracket locks 115 that secure the push frame 100 to a post of a vehicle frame, as shown in FIGS. 1A and 1B. The rear mounting brackets 110 and frame mounting bracket 120 shown are exemplary in nature and other types of mounting brackets are contemplated by the applicant, and depend, in part, upon the specific make and model of the all-terrain or utility-terrain vehicle to which the loader attachment apparatus 10 is being mounted.

The lift frame 200 includes a winch mount 210 and a second tension device, such as a second winch 220, used to control a second pivotal angle 295 of the bucket 300 about the second pivotal axis 290 by applying a force to a second cable 224 (bucket tilt cable), as shown in FIG. 2. Winches that may typically be used include 12 volt models that may supply from around 1000 to around 4000 pounds of tensile force, however, other winches may be used. Alternately a similar mount may be used to mount other means for providing a force to the bucket 300, such as a second linear actuator 222 (not shown). The lift frame 200 also includes a lift cable bar 230 with a rotating pulley 240 attached. The lift frame 200 further includes a lift stop 250 and a bucket tilt cable roller assembly 260 that includes a bucket tilt cable roller 262 and a bucket tilt cable roller support structure 264.

The lift frame 200 is pivotally attached by lift frame pivots 320 at a second pivotal axis 290 to an outer lift frame comprising brackets 310 and cross member 330. The second cable 224 (bucket tilt cable) is attached to the cross member 330. A bucket 300 is rigidly connected to the brackets 310 and may rotate about the second pivotal axis 290 along with the brackets 310 and cross member 330. The bucket tilt cable 224 runs from the cross member 330 over the bucket tilt cable roller 262 of the bucket tilt cable roller assembly 260 and into second winch 220 or linear actuator (not shown), which supplies the force to tilt the bucket 300.

Figures 3, 3A, 3B, 3C:
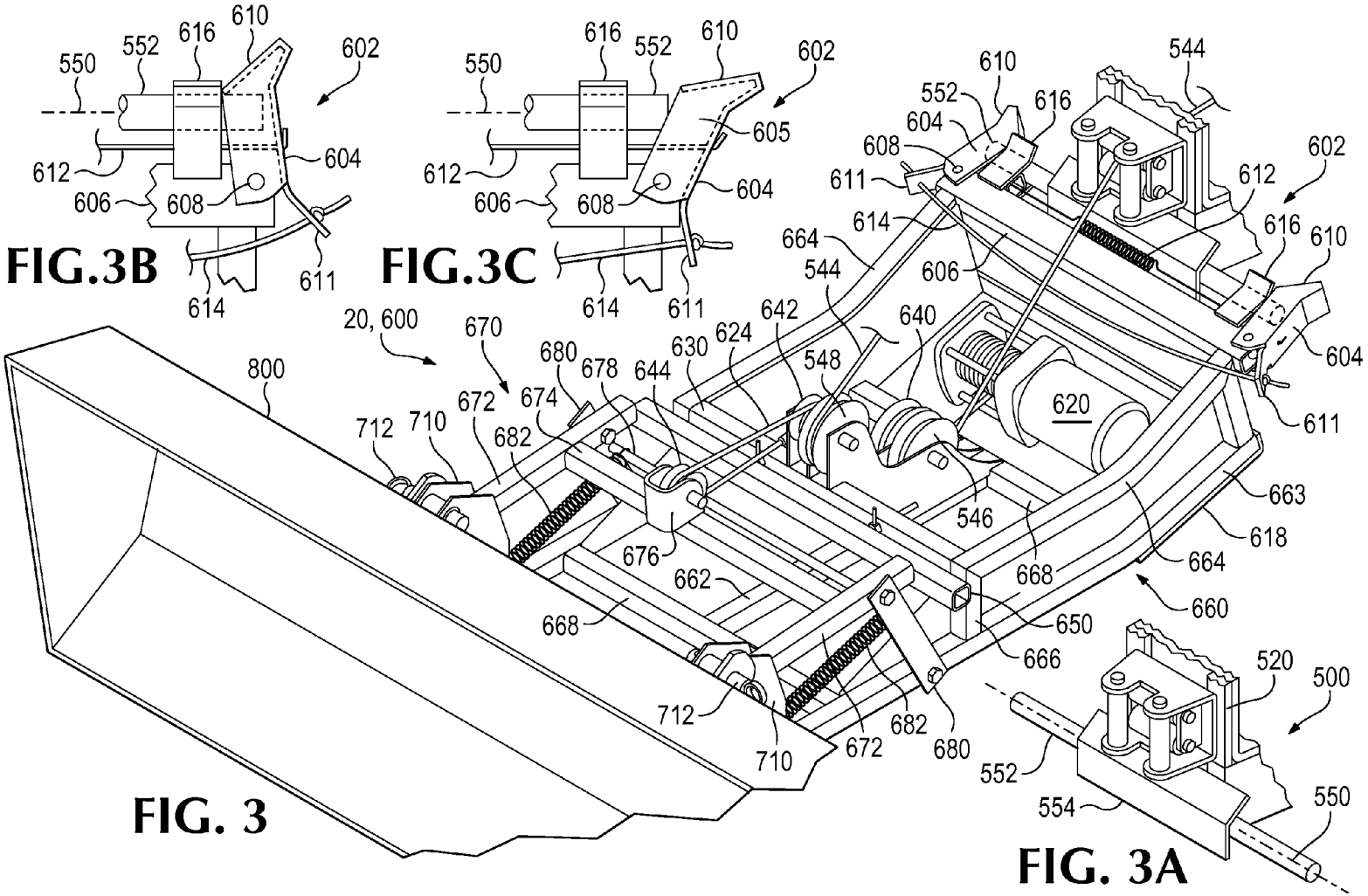
Figure 4:
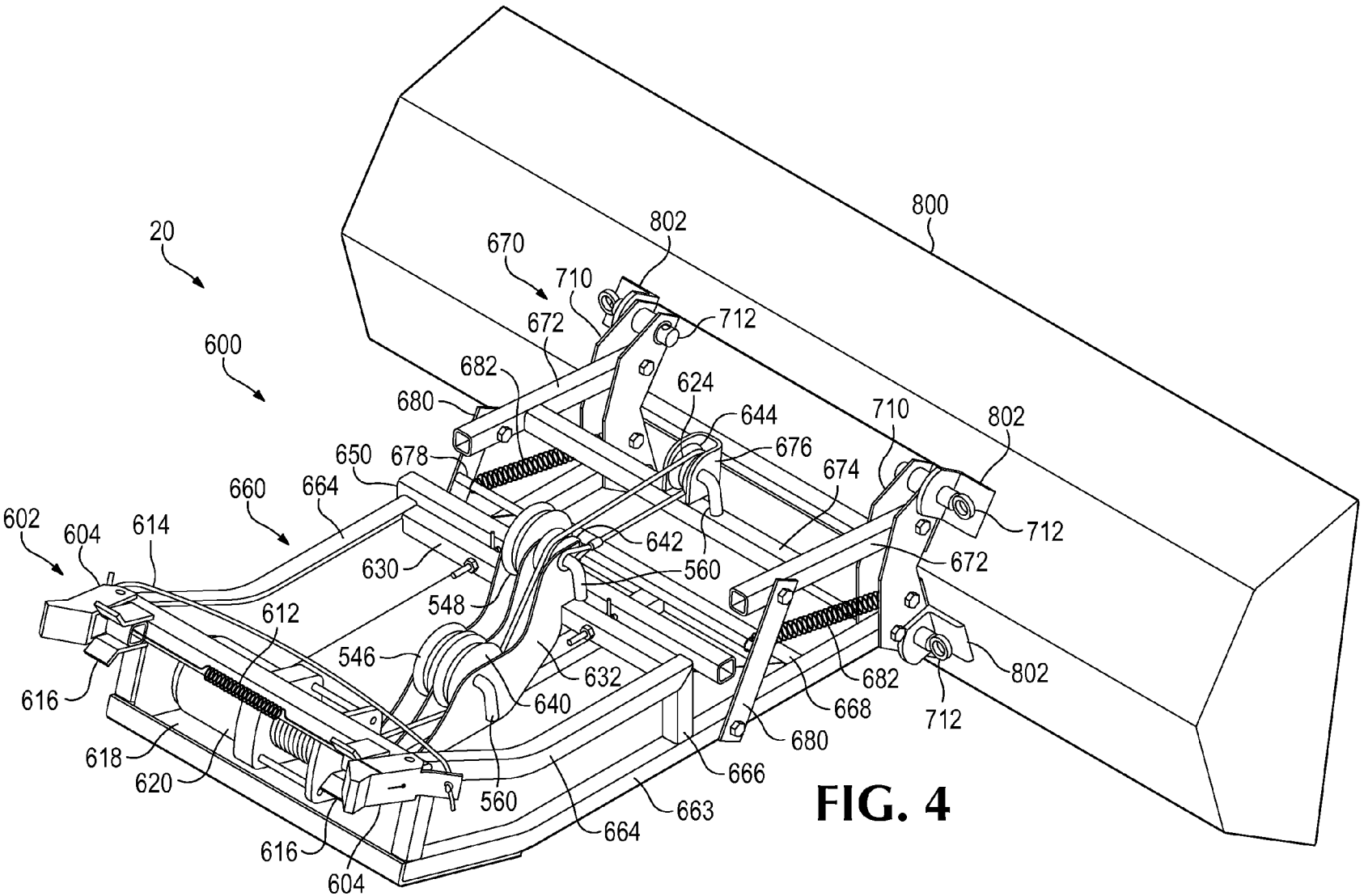
FIG. 4 shows a perspective view of another exemplary embodiment of the loader attachment apparatus before attachment to an all-terrain vehicle (ATV) or utility-terrain vehicle (UTV).
Figure 5:
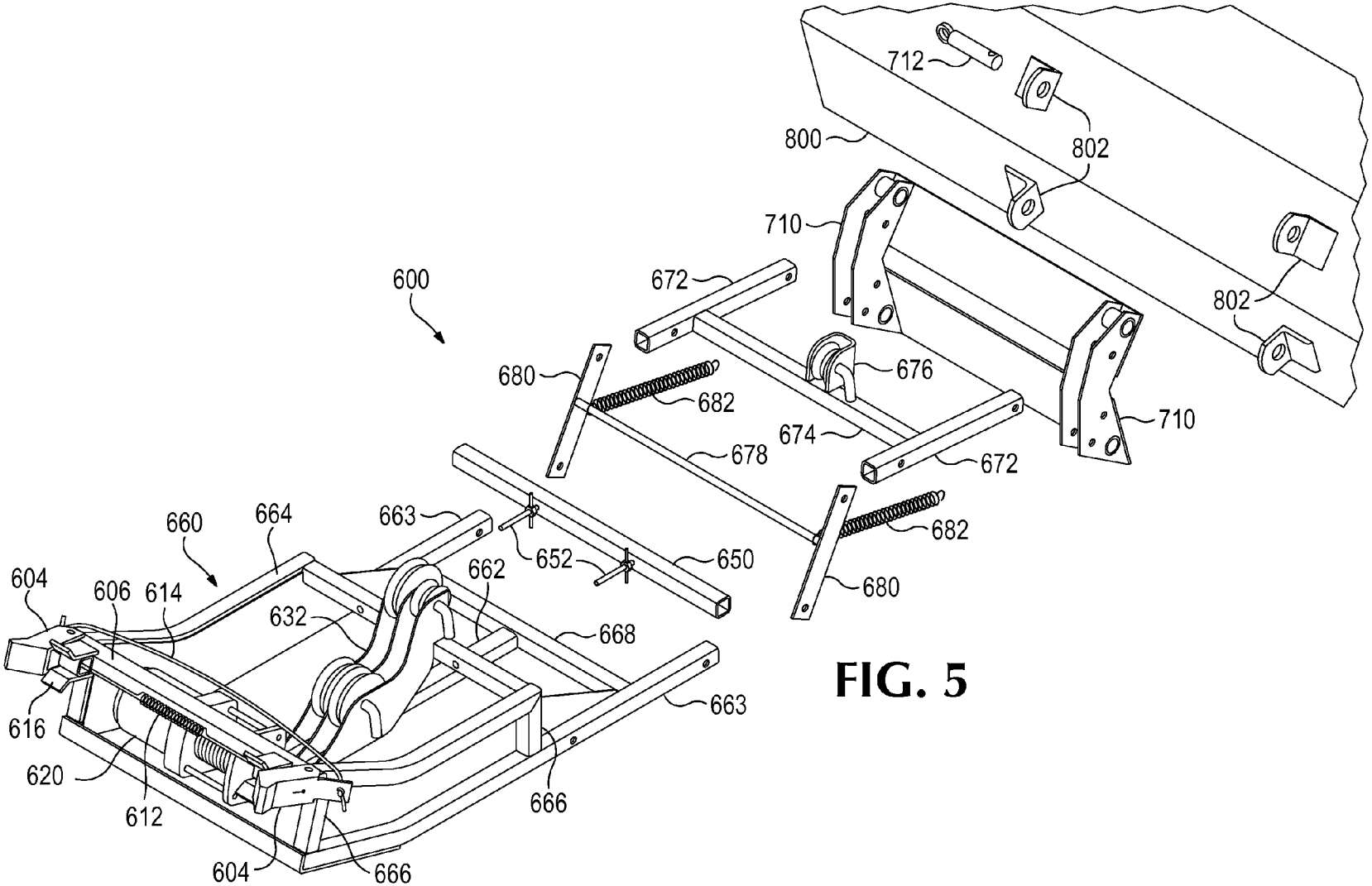
FIG. 5 shows an exploded view of another exemplary embodiment of the loader attachment apparatus.

Referring now to FIGS. 3 through 5, there is shown another exemplary embodiment of a loader attachment apparatus 20. In general, loader attachment apparatus 20 is configured to attach to a frame of an all-terrain or utility-terrain vehicle (ATV/UTV) through a frame mount, such as the frame mount 500 shown in FIG. 3. The loader attachment apparatus 20 comprises a lift frame 600 that may be pivotally attached to frame mount 500. The lift frame 600 comprises an inner lift frame 660 pivotally attached to an outer lift frame 670, and an implement mount 710 pivotally attached to both the inner lift frame 660 and the outer lift frame 670. An implement 800, such as a bucket implement 810, or a plow blade implement 820, or a pallet fork implement 830 is attached to the implement mount 710.

An embodiment of the frame mount 500 (see FIGS. 3A and 6) comprises one or more side frame mount brackets 510 and one or more front frame mount brackets 520, a first pivot rod 552 with a corresponding first pivotal axis 550 located at the centroid or along the longitudinal axis of the first pivot rod 552, and with one or more lift frame bracket stops 554 fixed to the outer cylindrical surface of the first pivot rod 552. The first pivot rod 552 comprises a generally cylindrical outer surface and may comprise a solid rod, or a hollow tube, for example. The side frame mount brackets 510 are configured to rigidly attach the frame mount 500 to a side frame member of an ATV/UTV, and the front frame mount brackets 520 are configured to rigidly attach the frame mount 500 to a front frame member of an ATV/UTV. The side frame mount brackets 510 and front frame mount brackets 520 shown are exemplary in nature, and other types of mounting brackets are contemplated by the applicant, and depend, in part, upon the specific make and model of the all-terrain or utility-terrain vehicle to which the loader attachment apparatus 20 is being mounted.

The frame mount 500 is pivotally attached to the lift frame 600 by a lift frame attachment assembly 602. The lift frame attachment assembly 602 comprises a lift frame attachment bracket rod 606 with lift frame attachment brackets 604 at each end, as shown in FIG. 3. The lift frame attachment brackets 604 are biased inwardly about lift frame attachment bracket axes 608 by lift frame attachment bracket spring 612. A lift frame attachment bracket release 614 is attached to a lift frame attachment bracket release wing 611 of the lift frame attachment bracket 604 to pivotally engage or disengage lift frame attachment bracket cavity 605 of the lift frame attachment bracket 604 with the first pivot rod 552 end.

To attach the lift frame 600 to the frame mount 500, the lift frame is positioned adjacent to the frame mount 500 so that the lift frame attachment brackets 604 are near each corresponding end of the first pivot rod 552 of the frame mount 500. The lift frame attachment bracket release 614 is configured to be pulled by a user to open the lift frame attachment brackets 604 while the user pulls the lift frame 600 on to the first pivot rod 552 of the frame mount 500. A lift frame attachment bracket angled portion 610, and a first pivot rod alignment bracket 616 aid the process of positioning the lift frame 600 correctly in relation to the first pivot rod 552 of the frame mount 500. Once each end of the first pivot rod 552 is positioned within the region directly adjacent the lift frame attachment bracket cavity 605, the lift frame attachment bracket release 614 is released so that the ends of the first pivot rod 552 are nested securely within each corresponding lift frame attachment bracket cavity 605, and each lift frame attachment bracket 604 is in contact with the lift frame bracket stop 554 of the frame mount 500, as shown in FIGS. 3B and 3C. Note that in some embodiments, a bushing (not shown), such as a sintered bronze bushing, may be fixed or pivotally mounted inside each lift frame attachment bracket cavity 605 to receive the each end of the first pivot rod 552 as each lift frame attachment bracket 604 is closed over its corresponding first pivot rod 552 end to prevent wear between each first pivot rod 552 end and the inside of each lift frame attachment bracket 604.

In one embodiment, a kickstand (not shown) may be used to lift the lift frame attachment brackets 604 to a height corresponding to a height of the first pivot rod 552. In some kickstand embodiments, once the lift frame 600 and the frame mount 500 are thus aligned, the ATV/UTV is placed in gear and moved forward slowly so that the first pivot rod 552 is guided by the first pivot rod alignment brackets 616 while the outer ends of the first pivot rod 552, which may be beveled, slide along the lift frame attachment bracket angled portion 610 of the lift frame attachment bracket 604 to pivot the lift frame attachment bracket 604 open until the outer ends of the first pivot rod 552 reach the lift frame attachment bracket cavity 605 of the lift frame attachment bracket 604 and the lift frame attachment bracket spring 612 closes the lift frame attachment brackets 604 over the ends of the first pivot rod 552 so that each lift frame attachment bracket 604 is in contact with the lift frame bracket stops 554 of the frame mount 500.

In still another embodiment, the lift frame attachment bracket assembly 602 is formed as a part of frame mount 500, and the first pivot rod 552 and lift frame bracket stops 554 are formed as a part of the lift frame 600. Other pivotal means are contemplated as well, such as first pivotal means that are wholly housed as an integral part of the lift frame 600.

Figure 6:
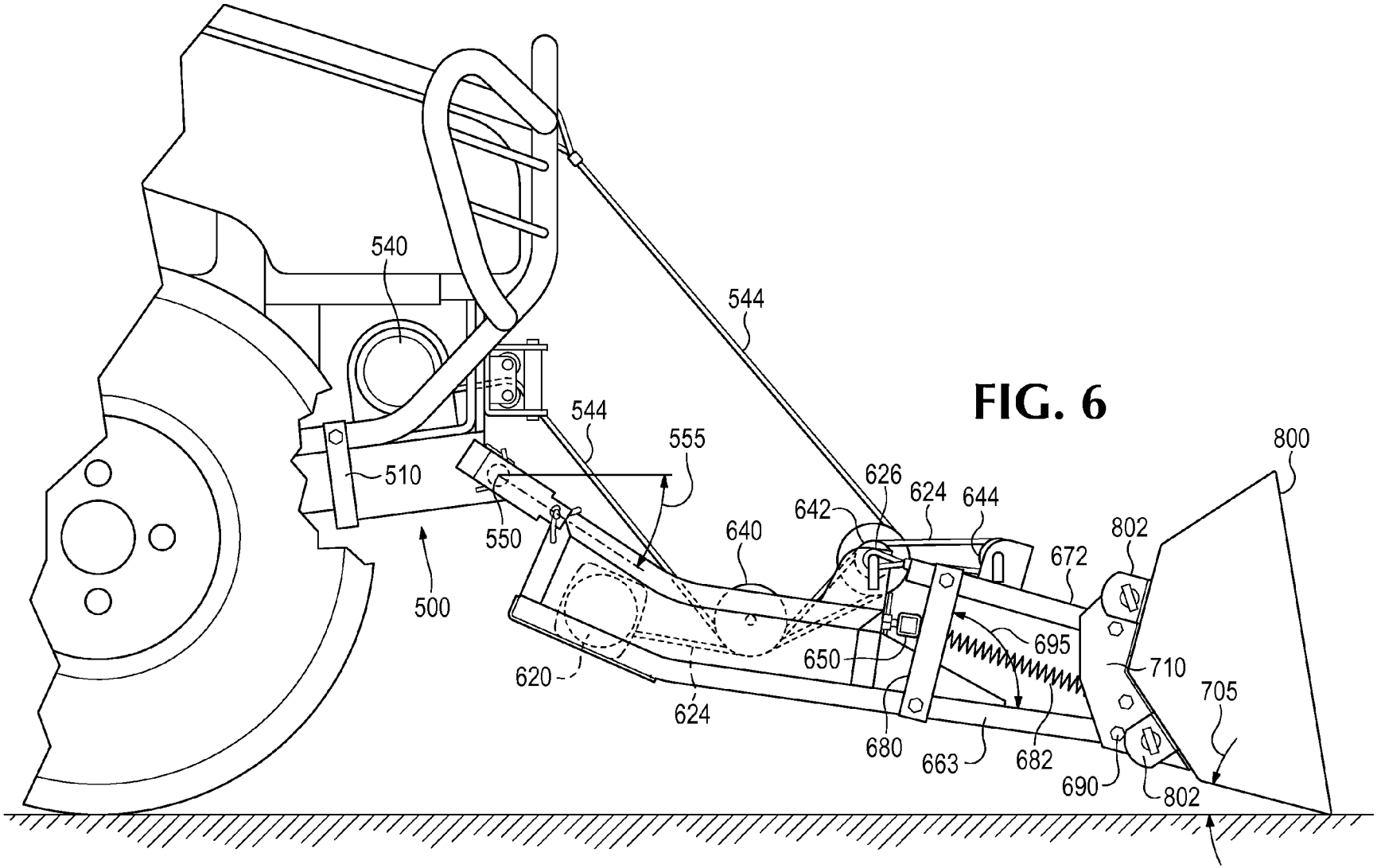
FIG. 6 shows a side elevation of another exemplary embodiment of the loader attachment apparatus attached to an all-terrain vehicle with a front edge of a bucket implement contacting the ground so that the bucket bottom makes a cutting angle with the plane of the ground.

Referring now to FIG. 6, there is shown an embodiment of the loader attachment apparatus 20 attached to an ATV through frame mount 500. The lift frame 600 may be rotated about the first pivotal axis 550 through a first pivot angle 555, wherein the inner lift frame 660 is configured to pivot about the first pivotal axis 550 by a first pivot angle 555 of between about 0 and 90 degrees (the first pivot angle 555 shown in FIG. 6 corresponds with 0 degrees). A tension device, such as a first winch 540 is also attached to the frame of the all-terrain or utility-terrain vehicle. Many ATV/UTV owners have installed such winches on their vehicles already, along with cable alignment rollers (see FIG. 3A). The front-mounted winch is a valuable tool in freeing a stuck vehicle in the backcountry, where an immobile vehicle can jeopardize the lives of those relying on the vehicle to return to locations where ample food and shelter are available. The first winch 540 runs off electricity (typically 12 volts). Winches that may typically be used include models that may supply from around 1000 to around 4000 pounds of tensile force. Alternately, other means for providing a force to the lift frame 600, such as a first linear actuator 542 (not shown), may be used. Currently available linear actuators typically supply around 1400 pounds of force in a 12 volt model. The first winch 540 is used to apply force through a first cable 544 (lift cable) to the lift frame 600 through a first lift cable pulley 546 and a second lift cable pulley 548 (shown in FIG. 4), which are both attached to the inner lift frame 660 through pulley mounting brackets 632 by pulley axle pins 560 and cotter pins (not shown).

The inner lift frame 660 includes a winch mount 618 and a second tension device, such as a second winch 620, used to control a second pivot angle 695 of the implement 800 about a second pivotal axis 690 by applying a tensile force to a second cable 624 (implement tilt cable) (see FIG. 6). The second pivot angle 695, measured between the linkage 680 of the outer lift frame 670 and the corresponding outer lower longitudinal frame member 663 of the inner lift frame 660 is around 90 degrees, and may be varied from about 15 degrees, as shown for example in FIGS. 8 and 9, to about 105 degrees, depending upon the position of an adjustable lift stop 650, described below. Winches that may typically be used include models that may supply from around 1000 to around 4000 pounds of tensile force. However, other winches may be used. Alternately a similar mount may be used to mount other means for providing a force to the implement 800, such as a second linear actuator 622 (not shown). Additionally, an electrical hydraulic actuator or an electro-mechanical actuator may be used to tilt the implement 800 about the second pivotal axis 690, in addition to supplying the force to pivot the lift frame 600 about the first pivotal axis 550. The second cable 624 winds around a portion of a first implement tilt cable pulley 640 and up over a portion of a second implement tilt cable pulley 642, then around a third implement tilt cable pulley 644, and is anchored at a tilt cable anchor 626. The first implement tilt cable pulley 640 is mounted on the same pulley axle pin 560, which extends through the pulley mounting brackets 632, as the first lift cable pulley 546. The second implement tilt cable pulley 642 and tilt cable anchor 626 are mounted on the same pulley axle pin 560, which extends through the pulley mounting brackets 632, as the second lift cable pulley 548. The pulley mounting brackets 632 are rigidly fixed to both an inner lift frame front lateral bar 630, as well as a center lower longitudinal frame member 662 located near the centerline of the inner lift frame 660.

The inner lift frame 660 also comprises outer lower longitudinal frame members 663 that are joined to upper longitudinal frame members 664 through upright posts 666, as shown for example in FIG. 5. Lateral frame members 668 rigidly connect the outer lower longitudinal frame members 663 with the center lower longitudinal frame member 662 to provide rigidity to the inner lift frame 660. The inner lift frame 660 also includes an adjustable lift stop 650 that is attached to the inner lift frame front lateral bar 630 through adjustable lift stop threaded rods 652 and nuts. The adjustable lift stop 650 limits the amount of rearward tilting of the implement mount 710 and implement 800 about the second pivotal axis 690, and may be used to set a cutting angle 705 of an implement 800 surface with respect to the ground. The adjustable lift stop 650 may also relieve the loading of the second cable 624, and absorb impulse loading encountered by an implement 800 during use as the implement 800 encounters objects as it translates along the ground. Instead of overloading the second cable 624, the load is transferred through the adjustable lift stop 650 to the vehicle frame through the inner lift frame 660.

The outer lift frame 670 comprises outer lift frame longitudinal members 672, an implement mount 710, linkages 680 and a tie rod 678, as shown, for example, in FIG. 5. The implement mount 710 is pivotally secured to the distal (away from the lift frame attachment bracket assembly 602) ends of the outer lower longitudinal frame members 663 of the inner lift frame 660 by pivot bolts and nuts at the second pivotal axis 690 (see FIG. 6). The implement mount 710 also attaches pivotally with pivot bolts and nuts to outer lift frame longitudinal members 672, also shown in FIG. 6. Each outer lift frame longitudinal member 672 also pivotally attaches with pivot bolts and nuts to a linkage 680, which is pivotally attached with pivot bolts and nuts to the outer lower longitudinal frame member 663. A tie rod 678 is rigidly attached between the two linkages 680, as shown in FIG. 4. A biasing spring 682 is located near each linkage 680, and runs between the tie rod 678 and the implement mount 710. The biasing springs 682 provide a rotational force or moment to the implement mount 710 that is in an opposite direction of the force or moment applied to the implement mount 710 by the second cable 624 to help the implement 800 maintain ground contact and to aid in unloading operations, such as the dumping of materials from the bucket implement 810. The outer lift frame 670 also includes an outer lift frame cross bar 674 that rigidly connects the outer lift frame longitudinal members 672, and has a third implement tilt cable pulley bracket 676 fixed near its midpoint. The third implement tilt cable pulley 644 is pivotally attached to the third implement tilt cable pulley bracket 676 by pulley axle pin 560 and cotter pin (not shown).

Figure 10A:
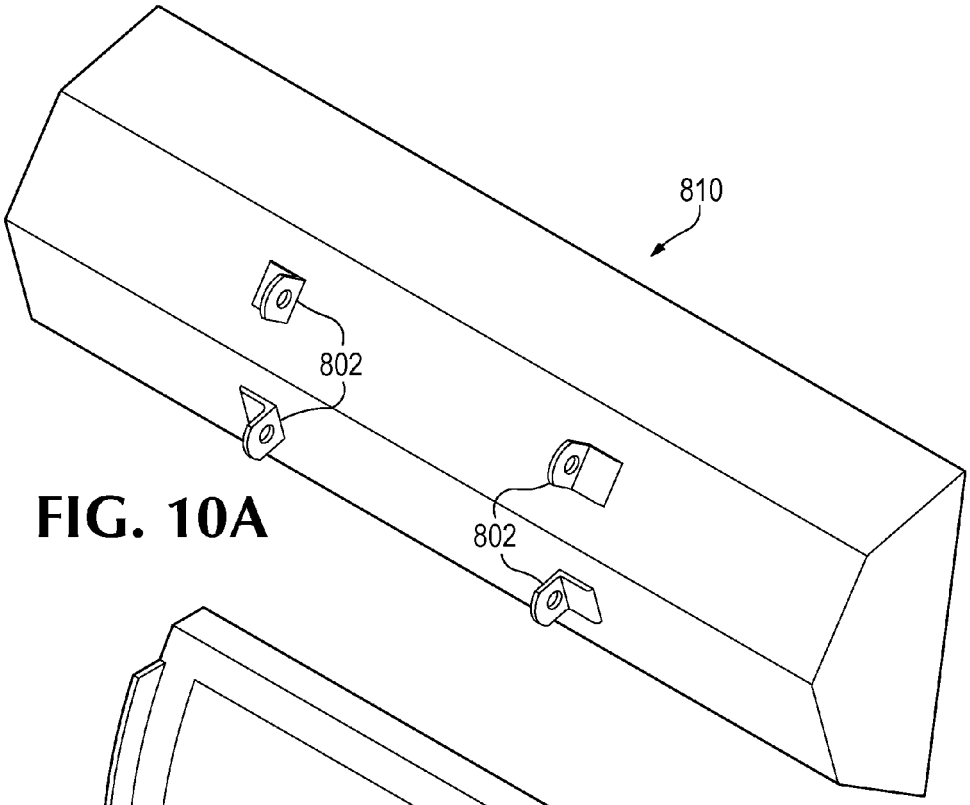
FIG. 10A shows a perspective view of an exemplary bucket implement for attachment to the loader attachment apparatus.
Figure 10B:
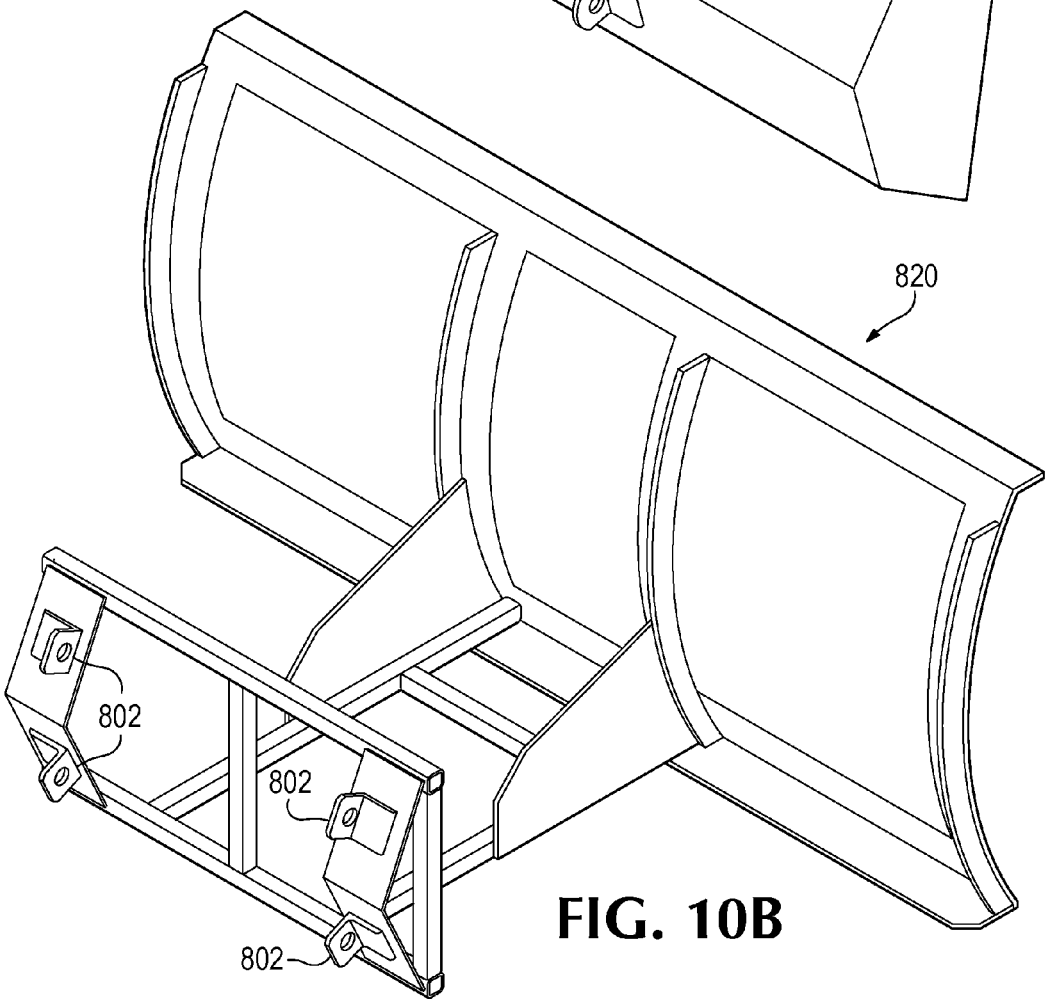
FIG. 10B shows a perspective view of an exemplary plow blade implement for attachment to the loader attachment apparatus.
Figure 11A:
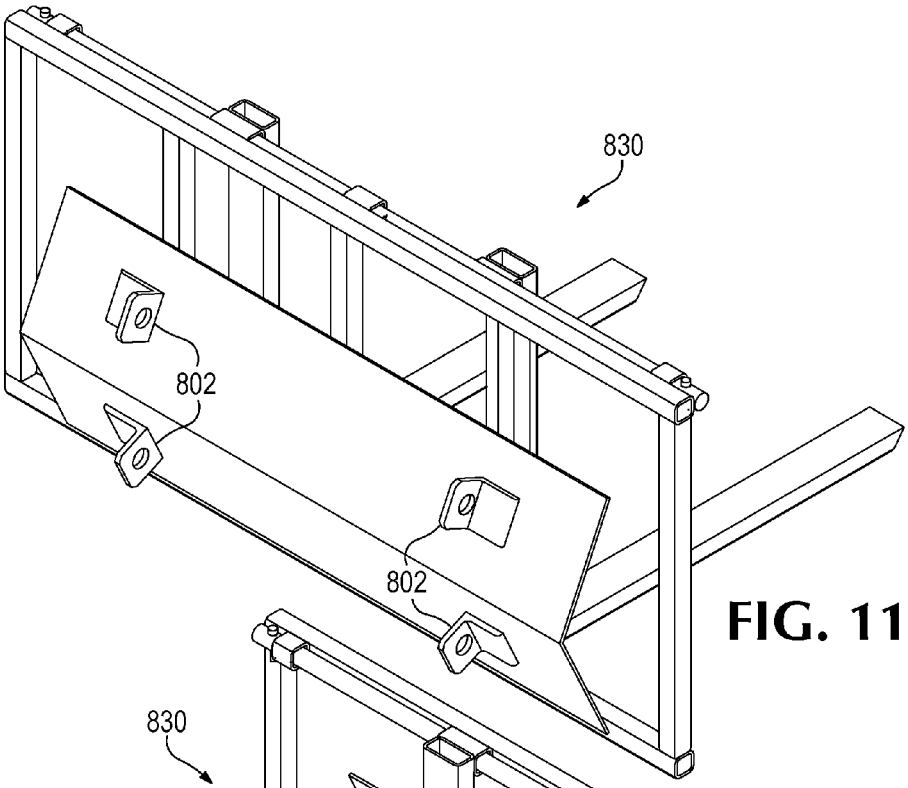
FIGS. 11A and 11B show a rear and front perspective views, respectively, of an exemplary pallet fork implement for attachment to the loader attachment apparatus.
Figure 11B:
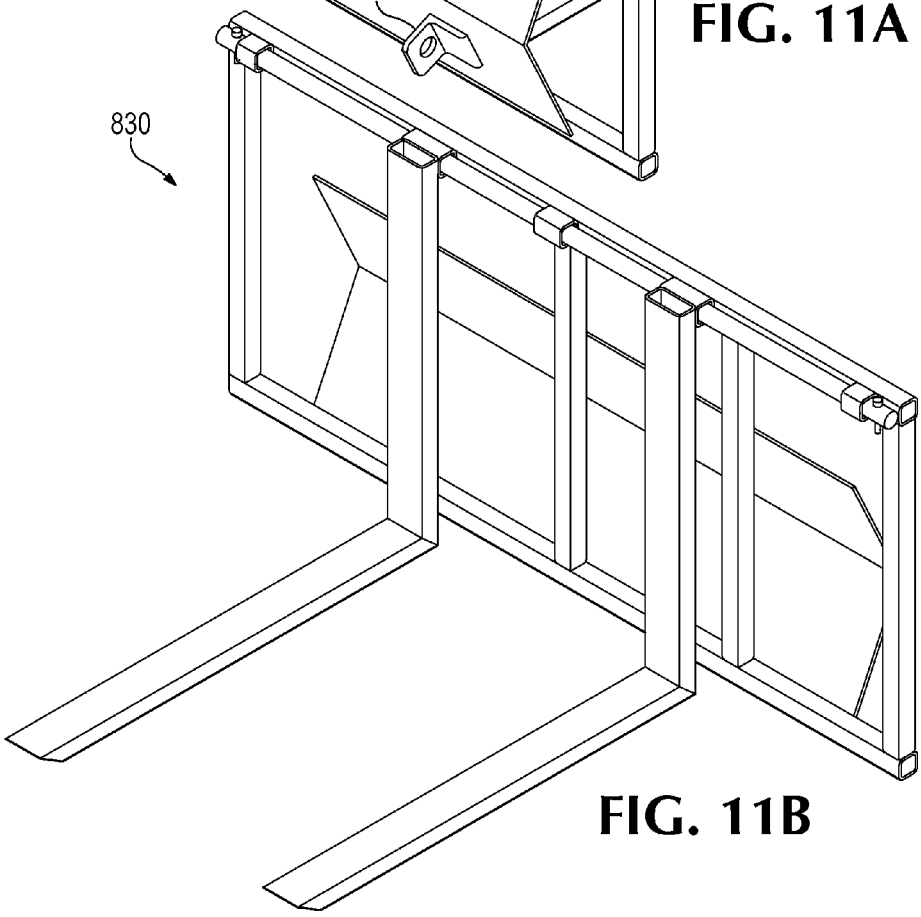

Implements 800, such as the bucket implement 810 (see FIG. 10A), the plow blade implement 820 (see FIG. 10B), or the pallet fork implement 830 (see FIGS. 11A and 11B) are attached to the loader attachment apparatus 20 with implement attachment pins 712, for example, which connect the implement mount 710 to implement brackets 802 of an implement 800, and are held in place with cotter pins (not shown).

Materials

The loader attachment apparatus embodiments may be constructed with various materials and techniques. In one embodiment, the structural components are constructed from wrought steel or aluminum tubing and/or channel that is fabricated, bent, formed, welded, and/or machined, as shown. Other components may be cast, forged, die cast, extruded, or injection molded, for example. Other materials and fabrication processes could also be used, such as constructing components from plastics, composite materials, and the like, depending upon the force requirements and cost, for example, of a particular component.

Loader Attachment Apparatus Use

The use of an exemplary embodiment of the loader attachment apparatus will now be described. Although the loader attachment apparatus 20 with bucket implement 810 will be used in this description, other implements 800 and/or the loader attachment apparatus 10 could have been used equally effectively, and are operated in much the same manner as the loader attachment apparatus 20 with the bucket implement 810. In particular, FIGS. 6-9 show an exemplary embodiment of the loader attachment apparatus 20 in a sequence of various positions associated with its use. The procedure for using the loader attachment apparatus 20 will now be described with reference to these Figures. The specific sequence or procedure for using the loader attachment apparatus 20 is exemplary in nature. Other sequences of steps or procedures may be used to obtain the same result and are contemplated by the applicant.

FIG. 6 shows a side view of an exemplary embodiment of the loader attachment apparatus attached to an all-terrain vehicle with the leading edge of the bucket implement 810 located roughly in the plane of the vehicle's contact with the ground. This will provide a starting point from which further positions and functions of the loader attachment apparatus 20 are described. Note that in this embodiment, the first cable 544 (lift cable), runs from the first winch 540, around the first lift cable pulley 546 and the second lift cable pulley 548, and is attached to an upper frame member of an ATV or UTV by a hook or other connection means (see also FIGS. 3-5). The second cable 624 (implement tilt cable) runs from the second winch 620 around a portion of the first implement tilt cable pulley 640 and up over a portion of the second implement tilt cable pulley 642, then around a third implement tilt cable pulley 644, and is anchored at a tilt cable anchor 626, as shown in FIG. 6. The loader attachment apparatus 20 is typically used in this position to load materials into the bucket implement 810, to clear snow from a driveway with either the bucket implement 810 or the plow blade implement 820, or to load a pallet onto the pallet fork implement 830. Cutting angle 705, as shown in FIG. 6, may be optimally set by positioning the adjustable lift stop 650. This is done by adjusting the length of the adjustable lift stop threaded rods 652 that is located on the implement side of the inner lift frame front lateral bar 630. In particular, the adjustment is made by loosening nuts on each adjustable lift stop threaded rod 652 (one nut is located on each side of the inner lift frame front lateral bar 630) and retightening the nuts so that the adjustable lift stop 650 is located in the desired position. Once the adjustable lift stop 650 is set for a particular implement, an optimal cutting angle may easily achieved by activating the second winch 640 to shorten the effective length of the second cable 624 so that linkage 680 pushes against the adjustable lift stop 650. Additionally, in this position, rearward forces generated when the implement 800 encounters an external object are transferred from the implement 800 through the adjustable lift stop 650 and the inner lift frame front lateral bar 630, through the lift frame 600 of the loader attachment apparatus 20 to the vehicle frame, rather than potentially overloading the second cable 624.

Figure 7:
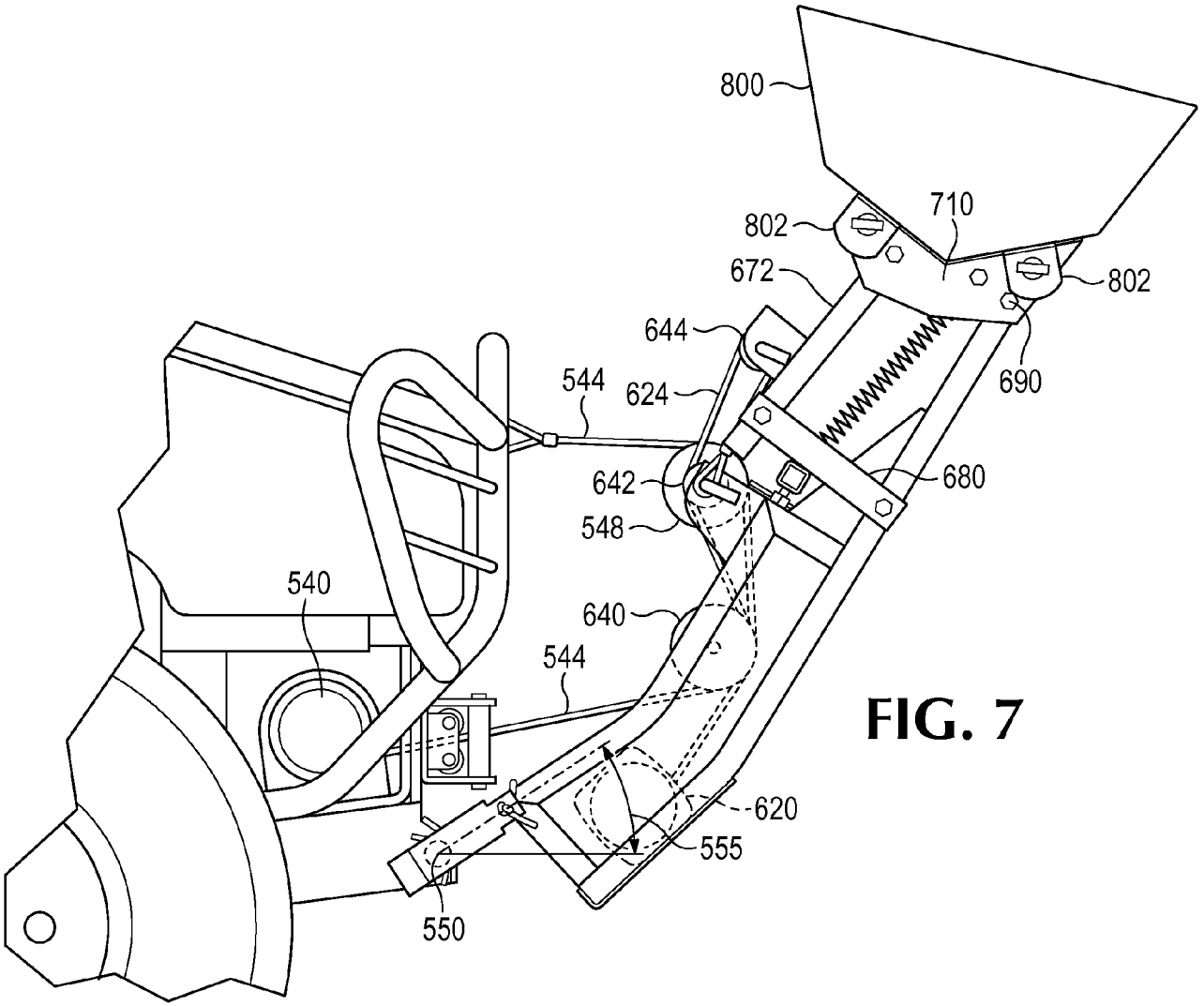
FIG. 7 shows a side elevation of the exemplary embodiment of the loader attachment apparatus shown in FIG. 6 where the bucket has been lifted upwards about a first pivotal axis, whereby the bucket may be rotated about a second pivotal axis to retain materials inside the bucket (no materials are shown inside the bucket in these exemplary figures).

FIG. 7 shows a side view of an exemplary embodiment of the loader attachment apparatus 20 attached to an all-terrain vehicle where the bucket implement 810 has been lifted upwards, from the position of FIG. 6, about the first pivotal axis 550 by an application of force by first winch 540 through the first lift cable pulley 546 and the second lift cable pulley 548. The loader attachment apparatus 20 is typically used in this position to transport loads of materials to from one location to another, especially if the load of material is heavy, since this position lessens the tipping moment (horizontal distance) relative to the front axle of the vehicle to help prevent vehicle tipping while traveling over uneven ground.

Note that the loader attachment apparatus 20 may be used in a position between those of FIG. 6 and FIG. 7 to carry a pallet of materials on the pallet fork implement 830 from one location to another, or to carry lighter loads of materials from one location to another in the bucket implement 810.

Means for actuating the first winch 540 include a three-way rocker or slider switch in electrical communication with the first winch 540. In a first position the switch feeds out cable, in the second position, the winch neither feeds out nor takes in cable, and in the third position, the winch takes in cable. Alternately a proportional-type throttle control could be used wherein the control feeds out or takes in cable at a rate proportional to the degree in which the control is activated in one direction or the other from a neutral starting point. Furthermore, a joystick type control can be used to control both winches at the same time.

Figure 8:
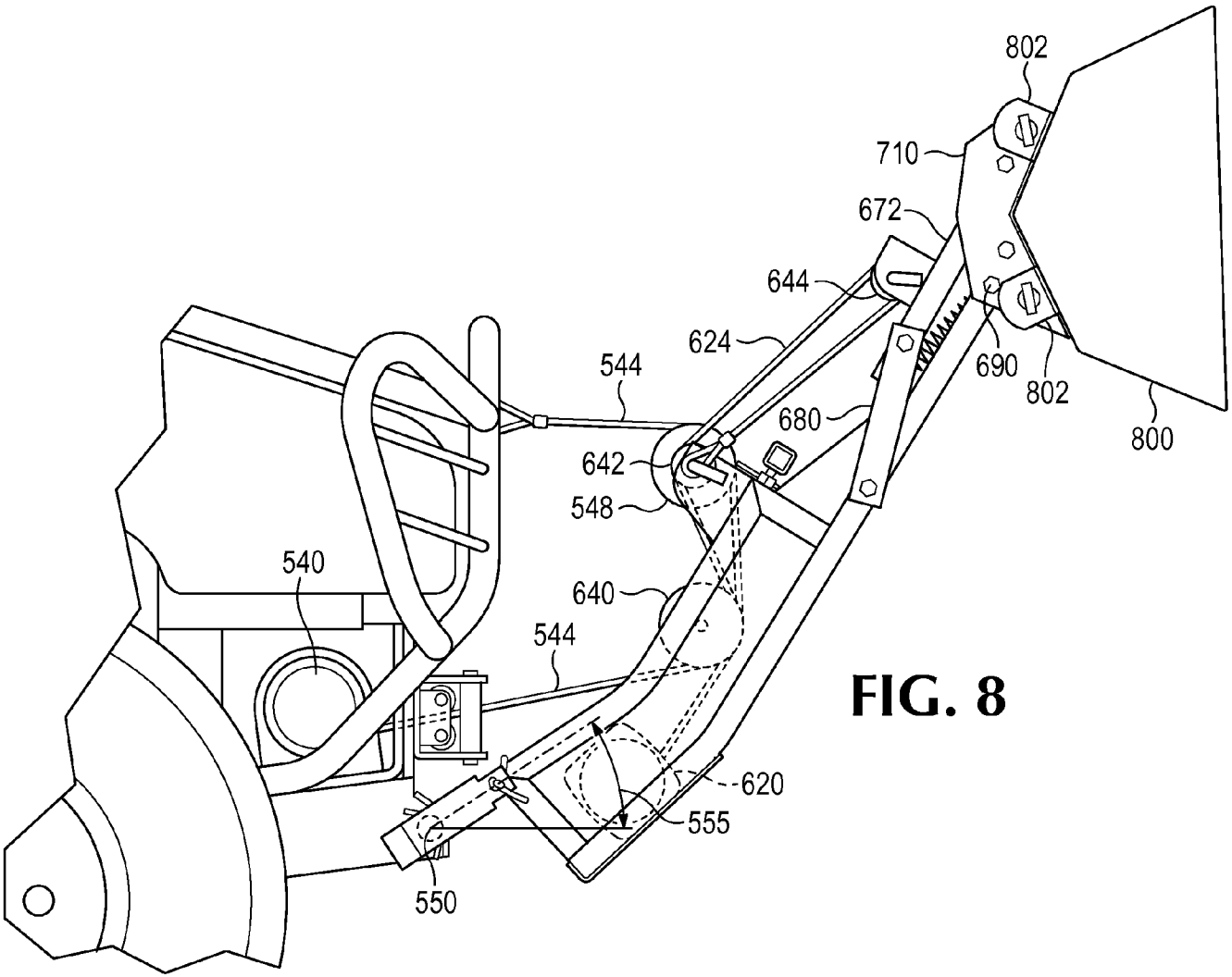
FIG. 8 shows a side elevation of the exemplary embodiment of the loader attachment apparatus shown in FIG. 7, whereby the bucket has rotated about the second pivotal axis to unload materials (not shown) inside the bucket.

FIG. 8 shows a side view of the exemplary embodiment of the loader attachment apparatus 20 shown in FIG. 7, whereby the bucket implement 810 has rotated about the second pivotal axis 690, through activation of the second winch 620, to feed out an additional length of the second cable 624 so that biasing springs 682 act through the tie rod 678, the linkages 680, and the outer lift frame longitudinal members 672 to tilt the bucket implement 810 forward about the second pivotal axis 690 to unload materials (not shown) that may be loaded inside the bucket implement 810.

An alternate means of activating both the first winch 540 and the second winch 620 that may prove useful, especially in the consumer ATV/UTV market, comprises a microprocessor controlled actuation means whereby a microprocessor reads code, embodied in a tangible medium, such as read-only memory, random access memory, or flash chip memory, or the like, attached to a button or switch, that when activated by a user, executes the code to simultaneously lift and tilt the bucket implement 810 from a first position to a second position, to aid users in executing complicated combination moves without simultaneously operating two separate winch controls.

Additionally, a sensor, such as a strain gage, may be incorporated into a structural member of the lift frame 600, whereby the sensor is configured to signal a warning device that is configured to warn a user that the loading of an implement 800 is too great in one or more of a plurality of implement 800 positions, thereby preventing overloading of the implement 800, which may lead to vehicle tipping. The electronics could be factory or user-set to correspond to the weight distribution relative to the vehicle's front axle of the particular vehicle make and model. For example, if a user tried to load and carry too heavy a payload, a warning light, buzzer, or the like, would sound off, or a lift prevention circuit could be tripped electronically, mechanically, or electromechanically. Alternately, or additionally, further lifting of the load, beyond an initial ground clearance lift to load the lift frame (and strain guage), by the first winch 540 could be prohibited by the microprocessor or a triggered switch.

Figure 9:
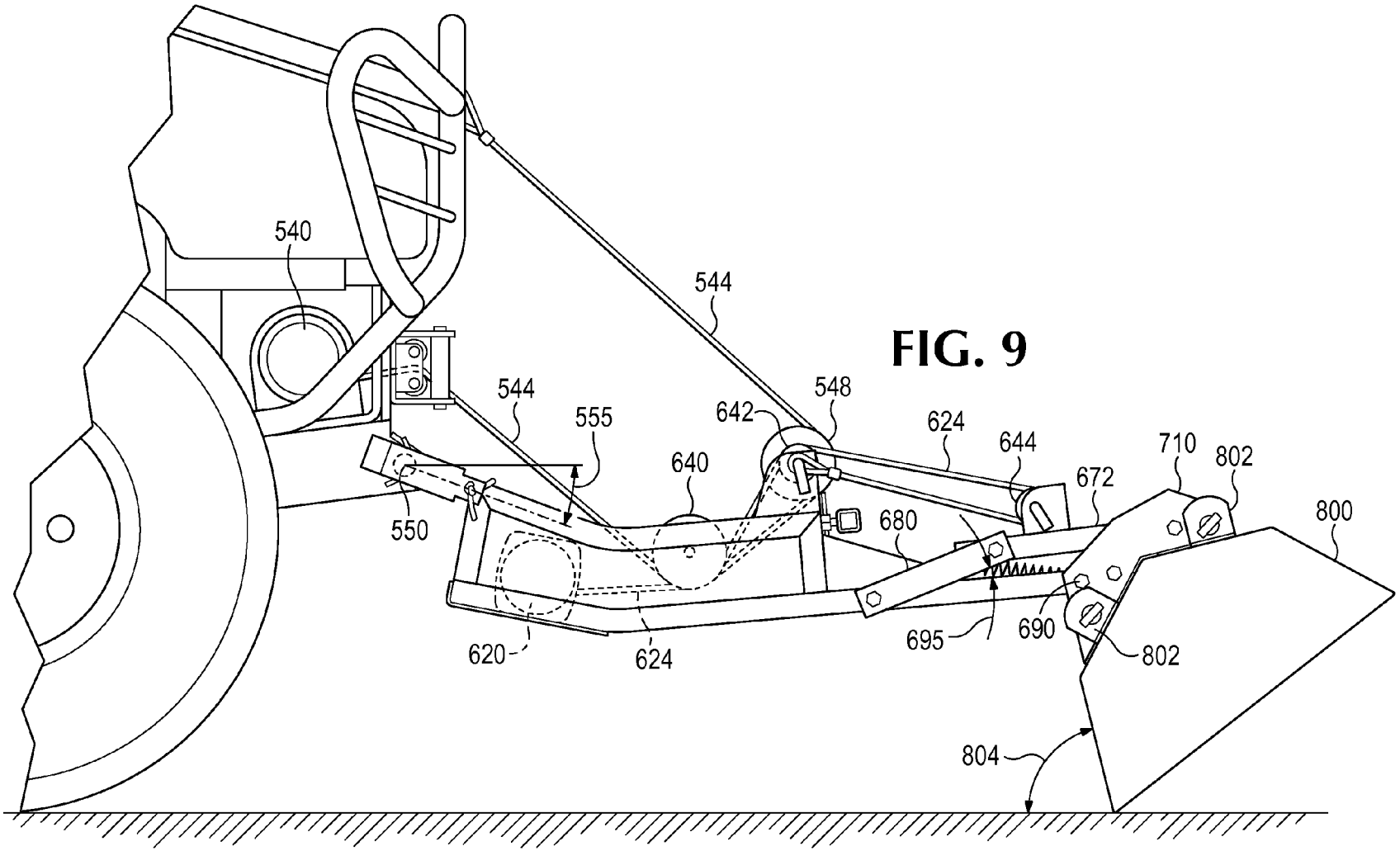
FIG. 9 shows a side elevation of the exemplary embodiment of the loader attachment apparatus shown in FIG. 8, whereby the bucket has rotated about the first pivotal axis to extend the unloaded bucket away from the vehicle in preparation for a scraping or leveling operation.

FIG. 9 shows a side view of the exemplary embodiment of the loader attachment apparatus 20 shown in FIG. 8, whereby the bucket implement 810 has rotated downward about the first pivotal axis 550 to extend the unloaded bucket implement 810 away from the vehicle in preparation for a scraping or leveling operation. Note that the second cable 624 is not under any appreciable tension and that the biasing spring 682, as well as the force of gravity, has caused the bucket implement 810 to rotate about the second pivotal axis 690 so that the lip of the bucket implement 810 is pointing generally downward and the leveling surface of the implement 800 makes a backdrag angle 804 with the ground. The backdrag angle 804 is an acute angle and may preferably be from 30 to 80 degrees. The scraping or leveling operation is typically performed with little, if any, tension applied to the first cable 544 and the second cable 624. The weight of the bucket implement 810 and lift frame 600 are allowed to translate through the front lip of the bucket implement 810 to drag material from relative high spots to relative low spots as the vehicle moves in a reverse direction.

It should be understood that even though these numerous characteristics and advantages of various embodiments have been set forth in the foregoing description, together with details of the structure and function of the exemplary embodiments, the disclosure is illustrative only, and changes may be made in detail, especially in matters of shape, size and arrangement of parts within the principals of the claimed embodiments in the appended claims to the full extent indicated by the broad general meaning of the terms in which the appended claims are expressed.

What is claimed is:

1. A removable loader for a vehicle, comprising:

a lift frame comprising an inner lift frame and an outer lift frame, wherein the inner lift frame has first and second ends, and wherein the outer lift frame has first and second ends;

a first pivotal axis, wherein the inner lift frame first end is configured to be pivotally mounted to a frame mount at the first pivotal axis, wherein the outer lift frame has a linkage at the outer lift frame first end and an implement mount at the outer lift frame second end, wherein the linkage is pivotally connected between the inner lift frame and the outer lift frame first end, and wherein the implement mount is pivotally connected to the inner lift frame second end;

an implement, wherein the implement is mounted to the implement mount, and wherein the implement is configured to pivot about a second pivotal axis, wherein the removable loader is configured to pivot about the first pivotal axis and the implement is configured to pivot about the second pivotal axis each by only one winch.

2. The removable loader of claim 1, wherein the inner lift frame is configured to receive a lift force from a first electrical winch cable of a first electrical winch, and wherein the removable loader further comprises a second electric winch that has a second electric winch cable that provides force to pivot the implement only about the second pivotal axis.

3. The removable loader of claim 2, further comprising:

a pulley bracket mounted on the inner lift frame; and a lift cable pulley mounted on the pulley bracket, wherein the lift cable pulley is configured to receive the first electrical winch cable.

4. The removable loader of claim 2, further comprising:

a pulley bracket mounted on the lift frame; and a first implement tilt cable pulley mounted on the pulley bracket, wherein the first implement tilt cable pulley receives the second electric winch cable.

5. The removable loader of claim 4, further comprising:

a second implement tilt cable pulley mounted on the pulley bracket, wherein the second implement tilt cable pulley receives the second electric winch cable;

a third implement tilt cable pulley, wherein the third implement tilt cable pulley receives the second electric winch cable, and wherein the third implement tilt cable pulley is mounted on the lift frame; and a tilt cable anchor, wherein the tilt cable anchor is attached to the pulley bracket mounted on the lift frame.

6. The removable loader of claim 1, further comprising:

an adjustable lift stop on the lift frame, wherein the adjustable lift stop is configured to transfer forces from an encountered external object through the linkage to the lift frame and vehicle frame, wherein the adjustable stop sets a cutting angle of the implement; and a biasing spring configured to pivot the implement about the second pivotal axis to dump a load of material.

7. The removable loader of claim 1, further comprising:

a quick connect configured to pivotally mount the inner lift frame to the vehicle, wherein the quick connect comprises a spring that biases a cavity of a lift frame attachment bracket inwardly over a pivot rod, and wherein the quick connect has a lift frame attachment bracket release attached to a lift frame attachment bracket release wing of the lift frame attachment bracket to release the lift frame attachment bracket from the pivot rod.

8. The removable loader of claim 7, further comprising:

a stand, wherein the stand is configured to temporarily raise the height of the inner lift frame to a height of the frame mount for the pivotal mounting of the inner lift frame to the frame mount, and wherein the cavity of the lift frame attachment bracket has a bushing to receive an end of the pivot rod.

9. The removable loader of claim 1, wherein the inner lift frame is configured to pivot about the first pivotal axis by a first pivot angle of between 0 and 90 degrees and wherein the implement is configured to pivot about the second pivotal axis by a second pivot angle of between 15 and 105 degrees.

10. The removable loader of claim 1, wherein the implement is one of: a loader bucket, a plow blade, and a pallet fork.

11. The removable loader of claim 1, further comprising:

a first winch to pivot the removable loader about the first pivotal axis.

12. The removable loader of claim 1, further comprising:

a second winch to pivot the implement about the second pivotal axis.

13. The removable loader of claim 12, wherein the second winch is mounted on the lift frame.

14. A vehicle comprising:

a vehicle;

a frame mount rigidly fixed to the vehicle;

a lift frame comprising an inner lift frame, an outer lift frame, a first pivotal axis, and a second pivotal axis, wherein the inner lift frame has first and second ends, wherein the inner lift frame first end is attached to the frame mount, wherein the outer lift frame has first and second ends, wherein the outer lift frame has a linkage at the outer lift frame first end and an implement mount at the outer lift frame second end, wherein the linkage is pivotally connected between the inner lift frame and the outer lift frame first end, and wherein the implement mount is pivotally connected to the inner lift frame second end;

a first winch configured to provide a lift force to the lift frame so that the lift frame pivots about the first pivotal axis, wherein only one winch is used to reversibly pivot the lift frame about the first pivotal axis;

an implement, wherein the implement is mounted to the implement mount and is configured to pivot about the second pivotal axis; and a second winch mounted on the lift frame, wherein the second winch is configured to provide a force that controllably pivots the implement only about the second pivotal axis, wherein only one winch is used to reversibly pivot the implement about the second pivotal axis.

15. The vehicle of claim 14, further comprising:

a lift cable pulley mounted on the lift frame;

a lift cable, wherein the lift cable pulley is configured to receive the lift cable, and wherein the first winch is configured to apply tension to the lift cable.

16. The vehicle of claim 14, further comprising:

a tilt cable pulley mounted on the lift frame;

a tilt cable, wherein the tilt cable pulley is configured to receive the tilt cable, and wherein the tilt cable controllably pivots the implement only about the second pivotal axis; and a tilt cable anchor, wherein the tilt cable anchor is attached to the lift frame.

17. A multi-use attachment for a vehicle, comprising:

a lift frame comprising an inner lift frame and an outer lift frame;

attachment means configured to attach a first end of the lift frame to a vehicle frame;

a first pivotal means to independently pivot the lift frame about a first pivotal axis, wherein the first pivotal axis is located at a first end of the lift frame;

a second pivotal means to independently pivot the outer lift frame relative to the inner lift frame about a second pivotal axis;

tensile means to controllably pivot only the outer lift frame relative to the inner lift frame;

pulley means to transfer a tensile load of the tensile means to the outer lift frame from the inner lift frame;_and means for attaching an implement to a second end of the lift frame.

18. The multi-use attachment of claim 17, wherein the pulley means comprise:

a tilt cable pulley mounted on the lift frame;

a tilt cable, wherein the tilt cable pulley is configured to receive the tilt cable, and wherein the tilt cable controllably pivots the implement only about the second pivotal axis; and a tilt cable anchor, wherein the tilt cable anchor is attached to the lift frame.

19. The multi-use attachment of claim 18, wherein the tensile means are provided by one of an electric linear actuator, an electro-mechanical actuator, an electrical hydraulic actuator, and an electric winch.

20. The multi-use attachment of claim 17, further comprising:

adjustable stopping means to transfer forces from an encountered external object through a linkage to the lift frame and vehicle frame, wherein the adjustable stopping means also sets a cutting angle of the implement; and biasing means configured to pivot the implement about the second pivotal axis to dump a load of material.

* * * * *